United States Patent [19]

Noda et al.

[11] Patent Number: 5,044,973

[45] Date of Patent: Sep. 3, 1991

[54] ELECTRICAL CONNECTOR

[75] Inventors: Atsuhito Noda; Osamu Hashiguchi; Mitsuo Komoto; Shoji Umesato, all of Tokyo, Japan

[73] Assignees: Japan Aviation Electronics Industry, Limited, NEC Corporation, both of Japan

[21] Appl. No.: 467,872

[22] Filed: Jan. 19, 1990

[30] Foreign Application Priority Data

Jan. 20, 1989 [JP] Japan ..... 1-9832

[51] Int. Cl.[5] ..... H01R 13/62

[52] U.S. Cl. ..... 439/296; 439/264

[58] Field of Search ..... 439/259, 260, 261, 262, 439/263, 264, 265, 266, 267, 268, 296, 79

[56] References Cited

U.S. PATENT DOCUMENTS 4,505,532 3/1985 Hine et al. ..... 439/264
4,519,660 5/1985 Ishimura et al. ..... 439/296
4,815,987 3/1989 Kawano et al. ..... 439/263
4,889,499 12/1989 Sochor ..... 439/268
4,912,772 3/1990 Beaudry, Jr. et al. ..... 439/79

*Primary Examiner*—Larry I. Schwartz
*Assistant Examiner*—Hien D. Vu
*Attorney, Agent, or Firm*—Laff, Whitesel, Conte & Saret

[57] ABSTRACT

For facilitating an electrical connection of a conductive connection pin (7) to a conductive contact (11) held to a base insulator (13), an electrical connector includes a preload pin (23) which is for carrying out beforehand displacement of a contact portion (21) of the conductive contact at a first position. The preload pin is held to a slider (19) which is placed between the base insulator and a cover insulator (17) and which is movable in a predetermined direction. The cover insulator and the slider have guide and elongated holes (15, 25), respectively, for passing the connection pin therethrough. The elongated hole is greater than the connection pin in a size of the predetermined direction. Therefore, it is possible without movement of the connection pin to move the preload pin in the predetermined direction to a second position at which the preload pin does not carry out the displacement of the contact portion.

5 Claims, 6 Drawing Sheets

ELECTRICAL CONNECTOR

BACKGROUND OF THE INVENTION

The present invention relates to an electrical connector or socket for electrically connecting the terminal pins of a circuit package to an LSI (large scale integrated) circuit, a printed circuit board and the like, and in particular to an electrical connector which can connect or disconnect the circuitry by moving parts or members of the connector or socket in the direction normal to the axis thereof.

A conventional connector of the above-mentioned type is schematically shown in FIG. 9, which depicts the case where an LSI circuit 2 is connected to a printed circuit board 1. A plurality of socket contacts 3 is embraced in a housing or base insulator 4. A cover insulator 6 is slidably combined with the base insulator 4. In the cover insulator 6, there is formed a plurality of penetrating guide holes 5. When a pin contact 7 of the LSI 2 is inserted into the corresponding guide hole 5, and the LSI circuit 2 is then moved in the direction of an arrow 8 together with the cover insulator 6, the pin contact 7 is brought into contact with the corresponding socket contact 3. More specifically, the pin contact 7 is brought into contact with the socket contact 3 as illustrated in FIG. 10. The pin contact 7 is in a laterally slidable manner inserted between a pair of resilient contact portions 9 extending from the socket contact 3 in the direction of the arrow 8 as illustrated in FIG. 10. As a result, the contact portions 9 are spread and slidably make press-contact with a peripheral surface of the pin contact 7.

FIG. 11 shows a graph in the case where the pin contact 7 is inserted between the pair of confronting contact portions 9 of the socket contact 3 and removed therefrom, with the insertion force and removal force plotted as ordinate and the lateral movement of the contact pin 7 as abscissa. In FIG. 11, since the directions of the insertion force and removal force are opposite to each other, the respective directions are shown by a positive direction and a negative direction in the graph. As can be seen from FIG. 11, a maximum value $F_P$ of the insertion force is greater than the removal force $F_X$, more specifically the maximum insertion force $F_P$ is approximately twice the removal force $F_X$. Furthermore, when the frictional force of the contact portions 9 and the contact pin 7 is P and the coefficient of friction between the pin contact 7 and the socket contact 3 is $\mu$, $F_X=2\ \mu P$. As a result, a large force is required for laterally inserting the pin contact 7 between the pair of contact portions 9 of the socket contact 3. Therefore, when a large number of socket contacts 3 are provided in this type of electrical connector, the insertion and removal operation is difficult.

Furthermore, as shown in FIG. 12, the initial fitting space g between the opposing contact portions 9 of the socket contact 3 must be smaller than the diameter of the pin contact 7. On the other hand, there must be an appropriate inner protrusion h on each of the contact portions 9 in order that the pin contact 7 can be smoothly laterally inserted between the contact portions 9 of the socket contact 3. In other words, the initial outer diameter $W_1$ of the contact portions 9 of the socket contact 3 must be larger than the diameter t of the contact pin 7. As a result, when the pin contact 7 is inserted into the socket contact 3, the outer diameter of the socket contact 3 is increased to $W_2$. Therefore, it is difficult to position a number of the socket contacts 3 with high density.

In the case where the socket contacts 3 are positioned with high density, the displacement $(t-g)/2$ of each resilient contact portion 9, which is equal to d/2, becomes extremely small, because the fitting space g between the contact portions 9 cannot be excessively reduced as can be seen from the above. Therefore, in order to obtain stable frictional force, the socket 3 must be fabricated by from a very hard spring, that is, a spring having a large spring constant. Therefore, if there is a fabrication error in the diameter of the pin contact 7 or a positional error thereof, the frictional force between the contact surfaces 9 and the contact pin 7 becomes insufficient for obtaining stable contact therebetween. In such a case, other problems occur. For example, the socket contact 3 may be excessively displaced so that excessive frictional force is caused between the contact surfaces 9 and the contact pin 7, and the resilient contact portions 9 are permanently deformed, or extremely large insertion and removal forces are required.

These problems occur not only in the case where the LSI circuit 2 is connected to the printed circuit board 1 as explained above, but also in the case where printed circuit boards are connected to each other.

SUMMARY OF THE INVENTION

Accordingly, it is a principal object of this invention to provide an electrical connector which can connect a conductive terminal pin member thereof to an electrical circuit by moving the parts or members of the connector so that the high density LSI circuit can be inserted with substantially no insertion force.

It is another object of this invention to provide an electrical connector of the above-mentioned type which can attain stable electrical connection even when there is an error in the diameter of conductive pin members or in the positioning thereof, with minimum variation in the driving force required for the operation of the connector.

It is a further object of this invention to provide an electrical connector of the above-mentioned type which can obtain a stable frictional force with connecting members.

According to this invention, there is provided an electrical connector for use in electrically connecting a conductive connection pin. The electrical connector comprises a base insulator, a conductive contact held to the base insulator and having a resilient contact portion, and a cover insulator having a penetrating guide hole which extends in a first direction for passing the connection pin therethrough so that the connection pin is brought in contact with the contact portion in a second direction which is perpendicular to the first predetermined direction. The electrical connector further comprises a slider placed between the base and the cover insulators and movable in a third direction which is perpendicular to the first and the second directions. The slider has an elongated hole for passing the connection pin therethrough. The elongated hole is greater than the connection pin in a size of the third direction. The electrical connector further comprises a preload pin held to the slider for displacing beforehand the contact portion to a predetermined position where the connection pin is to be brought in contact with the contact portion.

DETAILED DESCRIPTION OF PREFERRED EMBODIMENTS

Figure 9:
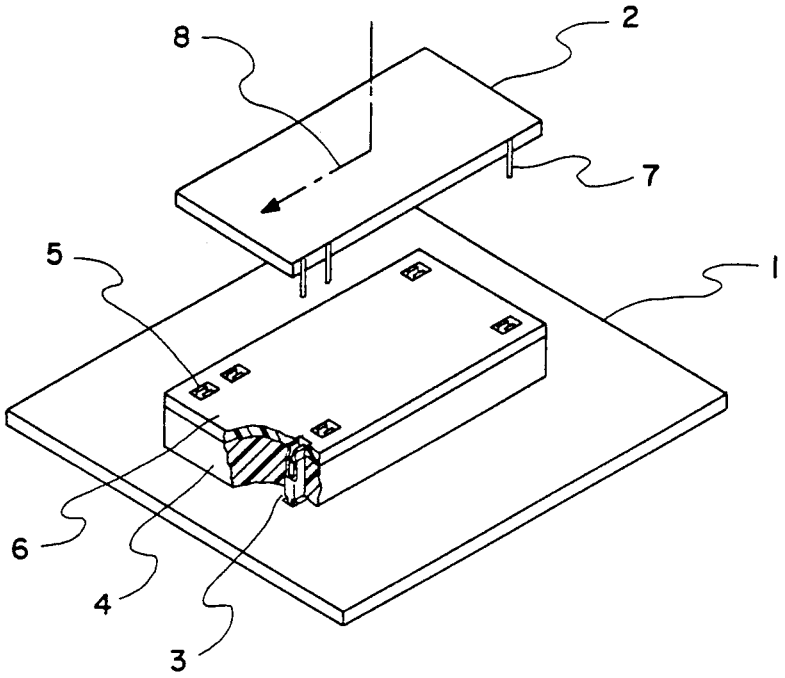
FIG. 9 PRIOR ART
FIG. 9 is a perspective view of a conventional example of an electrical connector in use.
Figure 10:
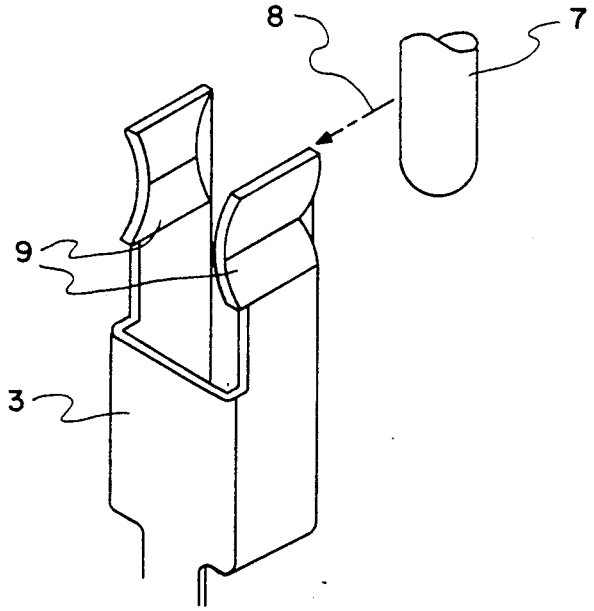
FIG. 10 PRIOR ART
FIG. 10 is a perspective view of the conventional electrical connector in explanation of the connection principle thereof.
Figure 11:
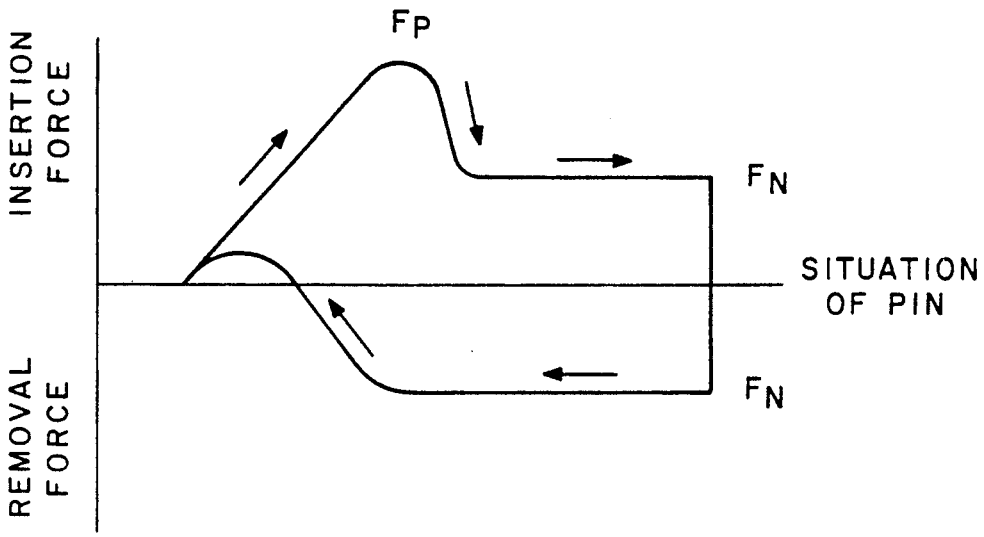
FIG. 11 is a diagram in explanation of the lateral insertion and removal forces of the conventional electrical connector shown in FIG. 9.
Figure 12:
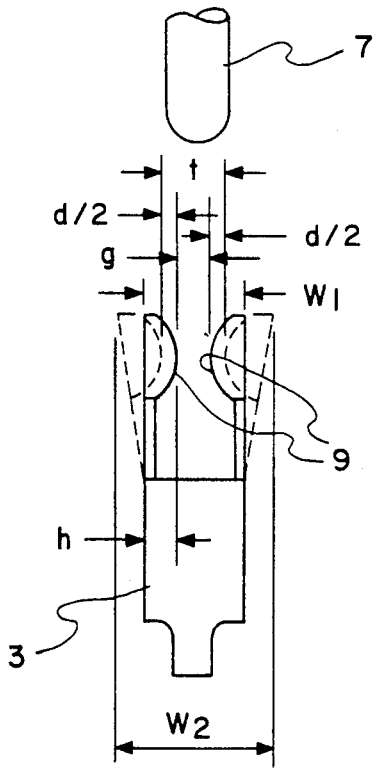
FIG. 12 PRIOR ART
FIG. 12 is a diagram in explanation of the programs of the conventional electrical connector shown in FIG. 9 at the time of the insertion and removal thereof.

With reference to FIGS. 1 to 7, an example of an electrical connector according to the present invention will now be explained. Throughout these figures, the same reference numerals as in FIG. 9 designate identical or corresponding parts in FIG. 9, and the explanation of the identical or corresponding parts in FIG. 9 is omitted.

Referring to FIGS. 1 to 4, the electrical connector of this invention comprises a base insulator 13 which supports a number of conductive socket contacts 11, and a cover insulator 17 having a number of penetrating guide holes 15. Each of the guide holes 15 extends in a first or vertical direction. The guide holes 15 are arranged in each of second and third directions which are perpendicular to each other in a horizontal plane.

Figure 1:
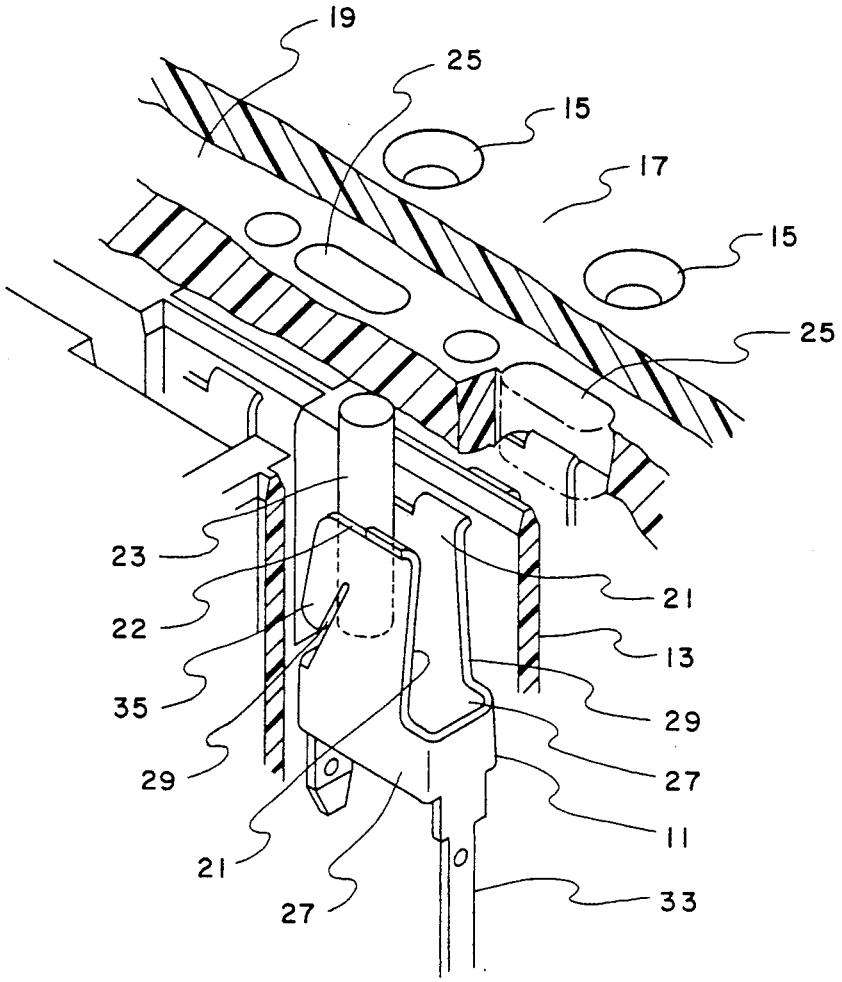
FIG. 1 is a perspective cross-sectional view of a main portion of an example of an electrical connector according to this invention.
Figure 2:
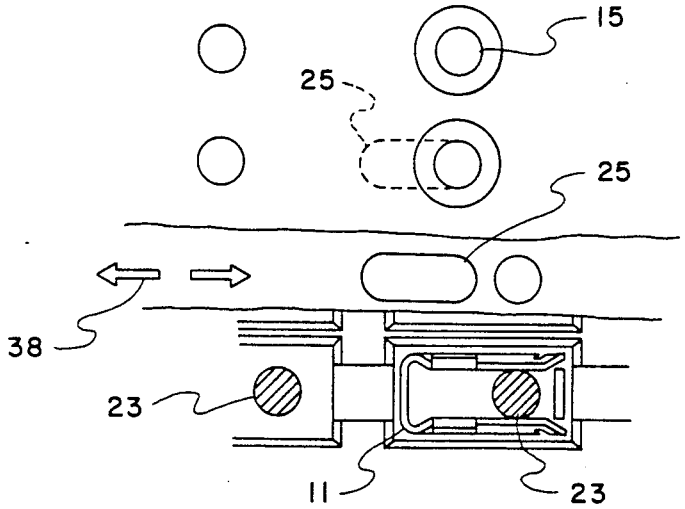
FIG. 2 is a plan sectional view of the electrical connector shown in FIG. 1.
Figure 8:
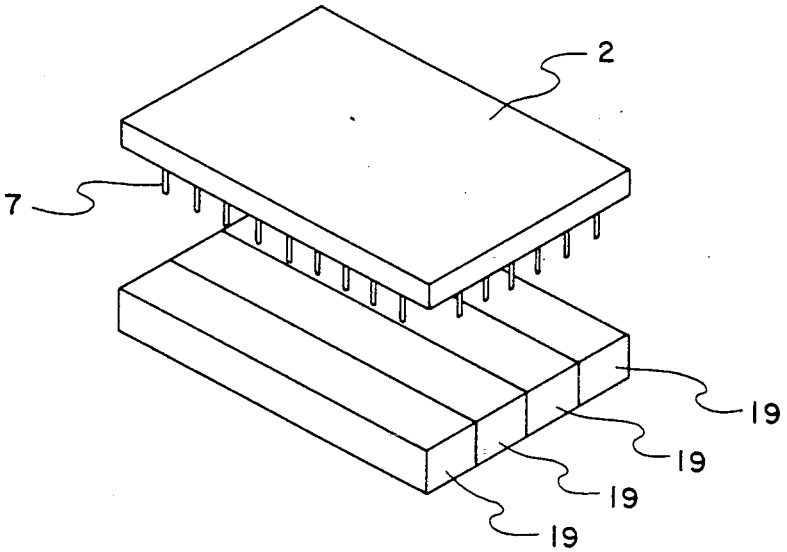
FIG. 8 is a perspective view of another example of an electrical connector according to this invention.

Between the base insulator 13 and the cover insulator 17, there is disposed a slider 19 which is movable in the third direction shown by arrows (a predetermined one of which is point out by a numeral 38) in FIG. 2. In this connection, the third direction is normal or perpendicular to the axis of the connection pin 7 of an LSI (large scale integrated) circuit 2 which is illustrated in FIG. 8. The slider 19 has a princpal surface, namely, a lower surface. The slider 19 fixedly supports a guide pin 23 (hereinafter referred to as the preload pin 23) in the vicinity of the guide hole 15. The preload pin 23 protrudes from the principal surface of the slider 19 to be inserted between a pair of additional portions 22 of the socket contact 11. In this embodiment, the preload pin 23 is in the form of a cylinder which has a predetermined axis and a peripheral surface surrounding the predetermined axis. The preload pin 23 is not limited to such a form shown in the figure, but may be in other form.

Figure 6:
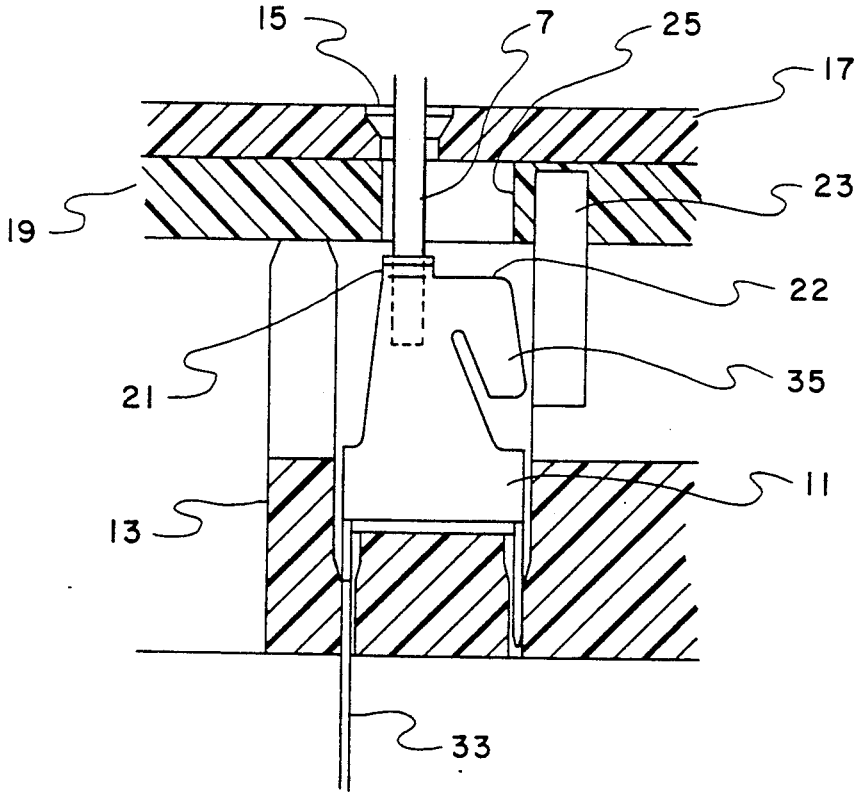
FIG. 6 is a side cross-sectional view of the connection pin of the LSI circuit and the socket contact in FIG. 5.

In the slider 19, an elongated hole 25 is formed in such a position as to face the corresponding guide holes 15. The elongated hole 25 allows the connection pin 7 of the LSI circuit 2 (FIG. 8) to be inserted therein as shown in FIG. 6 and extends in the third direction as shown in FIG. 2.

Figure 3:
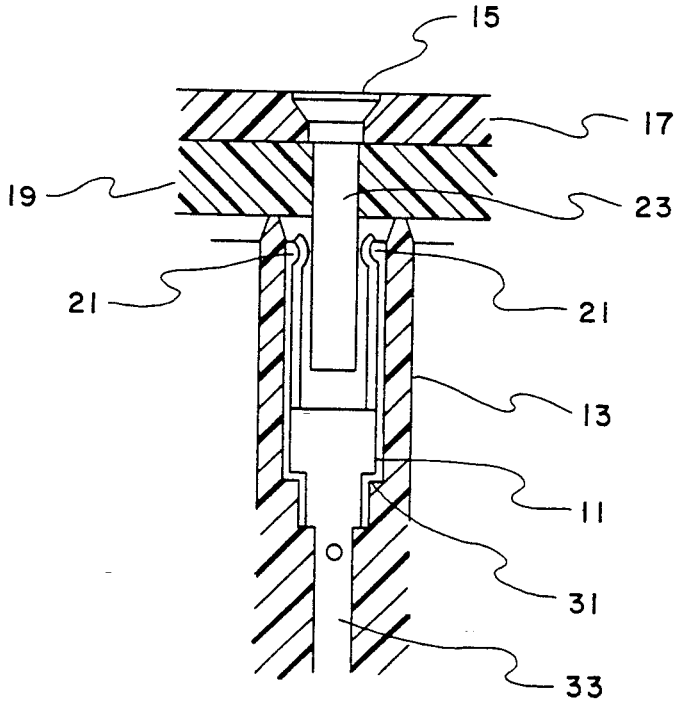
FIG. 3 is a cross-sectional view of a preload pin and a socket contact which are in contact.
Figure 4:
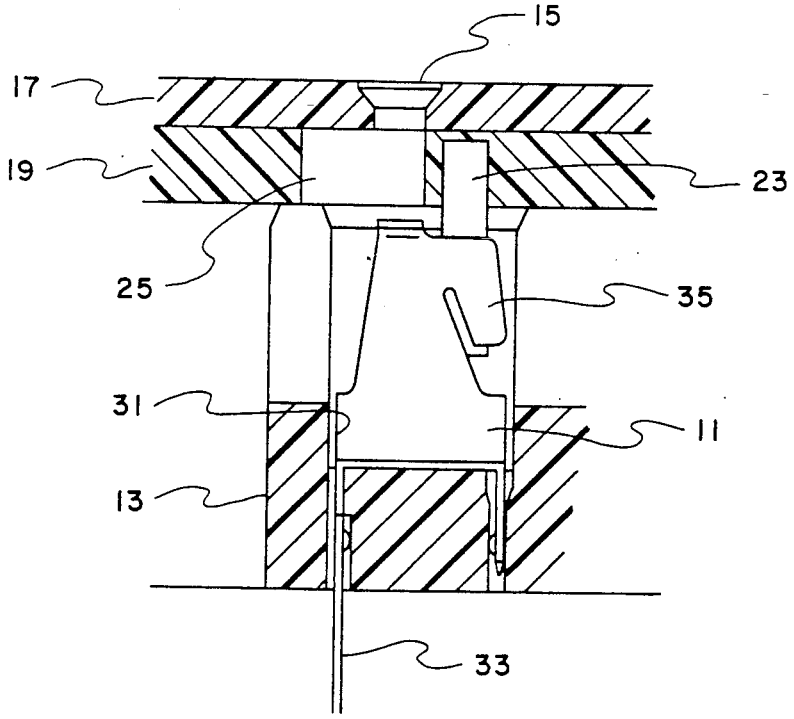
FIG. 4 is a side cross-sectional view of the preload pin and the socket contact in FIG. 3.

The socket contact 11 is made by punching or bending a conductive plate. The socket contact 11 includes a pair of support portions 27 and a pair of confronting plate-shaped spring arms 29. The pair of support portions 27 is fixedly inserted into a supporting hole 31 of the base insulator 11 as illustrated in FIGS. 3 and 4. Only one of the support portions 27 is integrally provided with a terminal member 33 which projects from the lower end of the socket contact 11.

The pair of spring arms 29 includes a pair of contact portions 21 at the top thereof. The pair of contact portions 21 face each other with a space therebetween. Each spring arm 29 integrally includes a projected guide member 35 at an upper side portion thereof. Each pair of these projected guide members 35 extends with an inclination from the support portions 27 in such a direction as to be separated from each other.

The preload pin 23 can be inserted between the pair of additional portions 22 of the socket contact 11 by moving the preload pin 23 in the third direction as will later be described in detail. The preload pin 23 has a diameter which is larger than the space between the additional portions 22. In addition, the diameter of the preload pin 23 is larger than that of the pin contact 7.

The cover insulator 17 is overlaid on the upper surface of the slider 19. The space between the contact portions 21 of the socket contact 11 is narrow when no external force is applied thereto. However, when the preload pin 23 is inserted between the additional portions 22, the space therebetween is spread. The contact portions 21 are thus displaced beforehand. As a result, the preload pin 23 is brought into press-contact with the additional portions 22.

Prior to the insertion of the connection pin 7 of the LSI circuit 2, the slider 19 is overlaid on the upper surface of the base insulator 11. At this moment, the preload pin 23 of the slider 19 extends in front of the projected guide members 35 of the socket contact 11.

The slider 19 is then moved in the third direction of the predetermined arrow 38 as illustrated in FIG. 2. When the slider 19 is moved in the third direction normal to the axis of the preload pin 23, the preload pin 23 is moved from the position of non-contact to the position of the particular portions 22.

After the preload pin 23 is inserted between the particular portions 22 to spread the space between the contact portions 21, the LSI circuit 2 is placed on the upper surface of the cover insulator 17. At this moment, the connection pin 7 of the LSI circuit 2 is passed through the guide hole 15 and the elongated hole 25 and reaches the contact portions 21.

In the above-mentioned structure, it can be seen that the connection pin 7 of the LSI circuit 2 can be inserted with substantially no insertion force. The connection pin 7 of the LSI circuit 2 has a diameter which is substantially same to the space between the contact portions 21. Preferably, the diameter of the connection pin is slightly less than the space.

Figure 5:
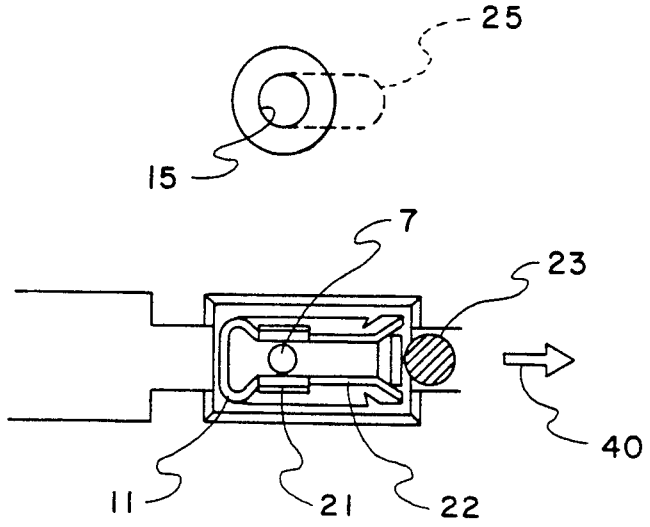
FIG. 5 is a plan view of a connection pin of an LSI circuit and a socket contact which are in contact.

The slider 19 is then moved in the direction of an arrow 40 as shown in FIG. 5. In accordance with the movement of the slider 19, the preload pin 23 is also moved slidably between the particular portions 21 in the third direction of the arrow 40. At this time, the elongated hole 25 of the slider 19 does not interface with the connection pins 7.

Figure 7:
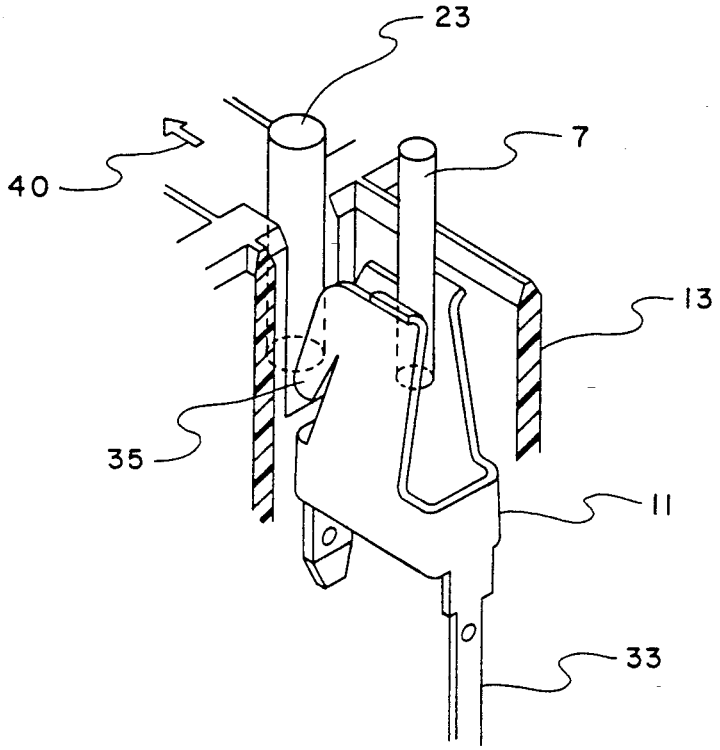
FIG. 7 is a perspective view of the connection pin of the LSI circuit and the socket contact in FIG. 5.

When the slider 19 is further moved in the third direction of the arrow 40, the preload pin 23 is moved slidably along the particular portions 21 and eventually only the preload pin 23 is disengaged from the projected guide members 35 as illustrated in FIGS. 5 to 7. Thus, the contact portions 21 are brought in press contact with the connection pin 7, so the necessary connection is achieved.

This connection can be released by moving the slider 19 in the direction of the arrow 38 as shown in FIG. 2 again.

When an LSI circuit 2 has many pins 7, as illustrate in FIG. 8, each operation force for sliding the slider 19 can be reduced by dividing a slider into several slider blocks 19 as shown in FIG. 8 and sliding them one by one.

In the above, the case where the connection pin 7 is inserted for connection between the contact portions 21. However, the present invention is not limited to the above case, but can be applied to the case where the connection pin 7 is brought in contact with only one of the contact portions of the contact of the above-mentioned type. In this case, substantially the same effects can be obtained as in the above explained case.

Thus, the electrical connector according to this invention has the advantages over conventional electrical connectors in those points that substantially no force is imposed on the connection pins of LSI and small stable force is required for sliding operations for connection and disconnection, and stable friction force is secured between mating pins and contacts, and multiple connections are easy and therefore a number of the connectors can be positioned with high density.

What is claimed is:

1. In an electrical connector for use in electrically connecting a conductive connection pin, comprising a base insulator, a conductive contact held to said base insulator and having a resilient contact portion, and a cover insulator having a penetrating guide hole which extends in a first direction for passing said connection pin therethrough so that said connection pin is bought into contact with said contact portion in a second direction which is perpendicular to said first predetermined direction, said base insulator being opposite to said cover insulator in said first direction, the improvement which comprises:

a slider placed between said base and said cover insulators and movable in a third direction which is perpendicular to said first and said second directions, said slider having an elongated hole which extends in said first direction for passing said connection pin therethrough, said elongated hole having a size which is greater than that of said connection pin in said third direction; and a preload pin held to said slider for displacing beforehand said contact portion in said second direction to a predetermined position where said connection pin is to be brought into contact with said contact portion.

2. An electrical connector as claimed in claim 1, wherein said slider has a principal surface facing said base insulator, and wherein said preload pin protrudes from said principal surface of the slider along a predetermined axis extending in said first direction.

3. An electrical connector as claimed in claim 2, wherein said preload pin has a peripheral surface surrounding said predetermined axis, said conductive contact having an additional portion adjacent to said contact portion, and wherein said peripheral surface of the preload pin is brought into press contact with said additional portion to displace said contact portion to said predetermined position when said preload pin faces said additional portion.

4. An electrical connector as claimed in claim 3, wherein said guide hole, said preload pin, and said elongated hole are arranged in a plane having said first and said third directions, said preload pin having a size which is greater than that of each of said guide hole and said connection pin in said second direction.

5. An electrical connector as claimed in claim 3, wherein said conductive contact has a guide portion which is connected to said additional portion for guiding said peripheral surface of the preload pin when said slider is moved in said third direction.

* * * * *